United States Patent [19]

Jannesari et al.

[11] Patent Number: 4,999,598

[45] Date of Patent: Mar. 12, 1991

[54] THREE-POSITION ACTUATING MECHANISM FOR TRANSFER SWITCH

[75] Inventors: Michael J. Jannesari, Spring Lake Park; Alan N. Fabian, Roseville, both of Minn.

[73] Assignee: Onan Corporation, Minneapolis, Minn.

[21] Appl. No.: 381,525

[22] Filed: Jul. 18, 1989

[51] Int. Cl.[5] ..... H01H 67/06; H01H 3/00

[52] U.S. Cl. ..... 335/122; 200/18

[58] Field of Search ..... 74/105; 200/18; 335/159, 160, 161, 122

[56] References Cited

U.S. PATENT DOCUMENTS

| | | | |
|---|---|---|---|
| 1,286,001 | 11/1918 | Hoeschen . | |
| 2,635,155 | 4/1953 | Barr | 200/91 |
| 3,238,319 | 3/1966 | Godel et al. | 335/122 |
| 3,798,395 | 3/1974 | Norman et al. | 200/18 |
| 4,016,385 | 4/1977 | Golioto | 200/18 |
| 4,021,678 | 5/1977 | Moakler et al. | 335/161 |
| 4,033,446 | 7/1977 | Taubert | 197/157 |
| 4,563,554 | 1/1986 | Perrenoud | 74/105 |
| 4,636,594 | 1/1987 | Patel et al. | 200/17 R |
| 4,760,278 | 7/1988 | Thomson | 200/18 |

*Primary Examiner*—Steven L. Stephan
*Assistant Examiner*—Nilay H. Vyas
*Attorney, Agent, or Firm*—Merchant, Gould, Smith, Edell, Welter & Schmidt

[57] ABSTRACT

A three-position actuating mechanism (10) for a transfer switch (11) is disclosed. The transfer switch is movable by the actuator (10) between a contact block (13) corresponding to a normal power source, and a contact block (14) interconnected to a standby or emergency power source. The actuator (10) has a pair of disk drives (22, 23) interconnected to solenoids (20, 21) by means of linkages (33, 34). The disk drives (22, 23) are interconnected to each other and to a driven disk (26) by means of a pin (30). Energization of the solenoids (20, 21) causes movement of the corresponding solenoid plunger (31, 32) and rotation of the disk drives (22, 23), so as to cause rotation of the contact crossbar (16) and transfer of the contacts (15, 18) between the two power sources.

10 Claims, 3 Drawing Sheets

10
20
21
22
23
25
26
30
31
32
33
34
37
38
16
4
4

10
20
21
23
25
27
28
29
30
31
32
33
34
35
36
37
40
41
42
43

THREE-POSITION ACTUATING MECHANISM FOR TRANSFER SWITCH

FIELD OF THE INVENTION

The present invention relates generally to transfer switches for transferring electrical loads from one power source to another, and more particularly to an actuating mechanism for use with transfer switches.

BACKGROUND OF THE INVENTION

The interruption of normal power supply can be caused by a variety of reasons, for example, earthquake, flood damage, adverse weather conditions, or utility unreliability. In the event that a normal power source, such as an electric utility, experiences an outage and fails, it is often necessary to supply critical and essential electrical needs by means of a standby electrical power system.

Often, the standby power supply system is an on-site electrical power source suitable to the needs of the applicable legal requirements and user criteria. The standby or emergency power supply system functions to provide a source of electrical power of required capacity, reliability and quality within a specified time after loss or failure of the normal power supply. The emergency power supply system varies depending upon the particular situation, for example, there may be a specified maximum time for which the load terminals of the transfer switch are permitted to be without acceptable electrical power. Quick transfer is especially important where critical equipment is involved, as in hospitals, airports and computer installations.

With conventional transfer switches, it is possible for the load to be transferred to the standby power source before the standby power source has built up enough energy to sufficiently handle the load. To address this problem, a suitable timer mechanism must be employed to delay the transfer, or a capacitor must be employed to supply the necessary power at the outset after transfer.

One type of conventional transfer switch utilizes a linear actuator mechanism which has a single central solenoid with a plunger which can be ejected from either end. On each side of the solenoid are two separate contact blocks. With this design, a bidirectional linear induction motor is utilized. As mentioned above, one or more boosters or motor-starting capacitors are required. In order to prevent the application of power to the load from both sources at the same time, this linear actuator mechanism also has a mechanical interlocking beam.

However, conventional actuator mechanisms such as the one described require a substantial amount of space, thereby making the unit unsuitable for some applications and more costly. Further, the linear motor utilized with the conventional transfer switch is relatively expensive and requires additional space.

In addition, it is possible for the interlocking beam to become displaced, for example, if a screw becomes loose. In that event, power could be applied from both the primary power source and the standby power source, which could result in dangerous short circuits and destruction of the standby system.

The present invention addresses these and many other problems associated with currently available transfer switches.

SUMMARY OF THE INVENTION

The present invention comprises an actuating mechanism for moving an electrical transfer switch between two power sources. The actuator mechanism is used in conjunction with an electrical transfer switch of the type having a plurality of contacts mounted upon a rotatable cross bar and movable between first and second stationary contact bars corresponding to two different power sources, for example, a normal power source and an emergency power source. The transfer switch is movable by the actuator between the contact block corresponding to the normal power source and a contact block corresponding to the standby or emergency power source. The actuator comprises first and second rotatable drive disks in parallel relationship which are interconnected by a pin which extends through a slot in the rotatable drive disks, the pin also being connected to a third, parallel driven disk. The driven disk is interconnected to the cross bar which supports the movable contacts, so that rotation of the driven disk causes rotation of the cross bar, thereby accomplishing the power transfer. There are also linear actuating means which are suitably interconnected to the pins so as to cause rotational movement of the pin. In the preferred embodiment, the actuating means comprises electromagnetic means such as a pair of solenoids, each solenoid being interconnected to one of the drive disks. Preferably, the solenoid plungers and drive disks are interconnected by suitable linkage means having a pivotal connector on each end thereof.

A particular advantage of the present invention is its "load shedding" capability; that is, the actuating mechanism is able to move into a neutral position wherein power is transmitted from neither source. This feature is useful, for example, in the event the standby power source does not immediately have sufficient voltage to supply the necessary power. In this situation, the actuator of the present invention can be placed in the neutral position for the number of seconds required until the proper voltage is achieved, which may range from a fraction of a second to twenty seconds or more.

Another feature of the actuator of the present invention is that it does not draw as much current at the outset when the transfer operation takes place. The actuating mechanism requires less energy to operate, because of the reduction in the number of necessary parts and the simplicity of construction, so that the actuator has less mass to move. Because less energy is required, a capacitor is not necessary.

Another feature of the present invention is that it requires less space than conventional transfer switch actuators, thus enabling the actuator to be positioned even where there are tight space constraints. This feature results in an actuator which is more cost-effective.

For a better understanding of the invention, and of the advantages obtained by its use, reference should be made to the Drawing and accompanying descriptive matter, in which there is an illustrated and described a preferred embodiment of the invention.

BRIEF DESCRIPTION OF THE DRAWING

Referring particularly to the Drawing, wherein like reference numerals indicate like parts throughout the several views.

DETAILED DESCRIPTION OF THE PREFERRED EMBODIMENT

Figure 1:
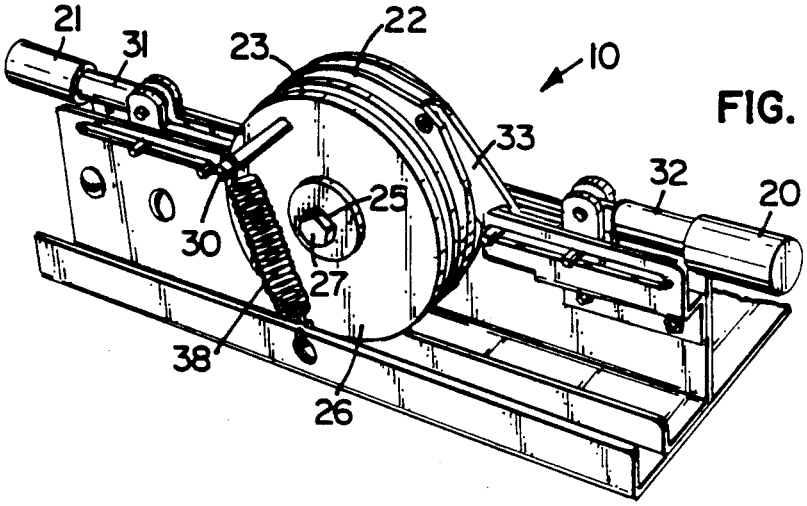
FIG. 1 is perspective view of the actuating mechanism of the present invention.
Figure 2:
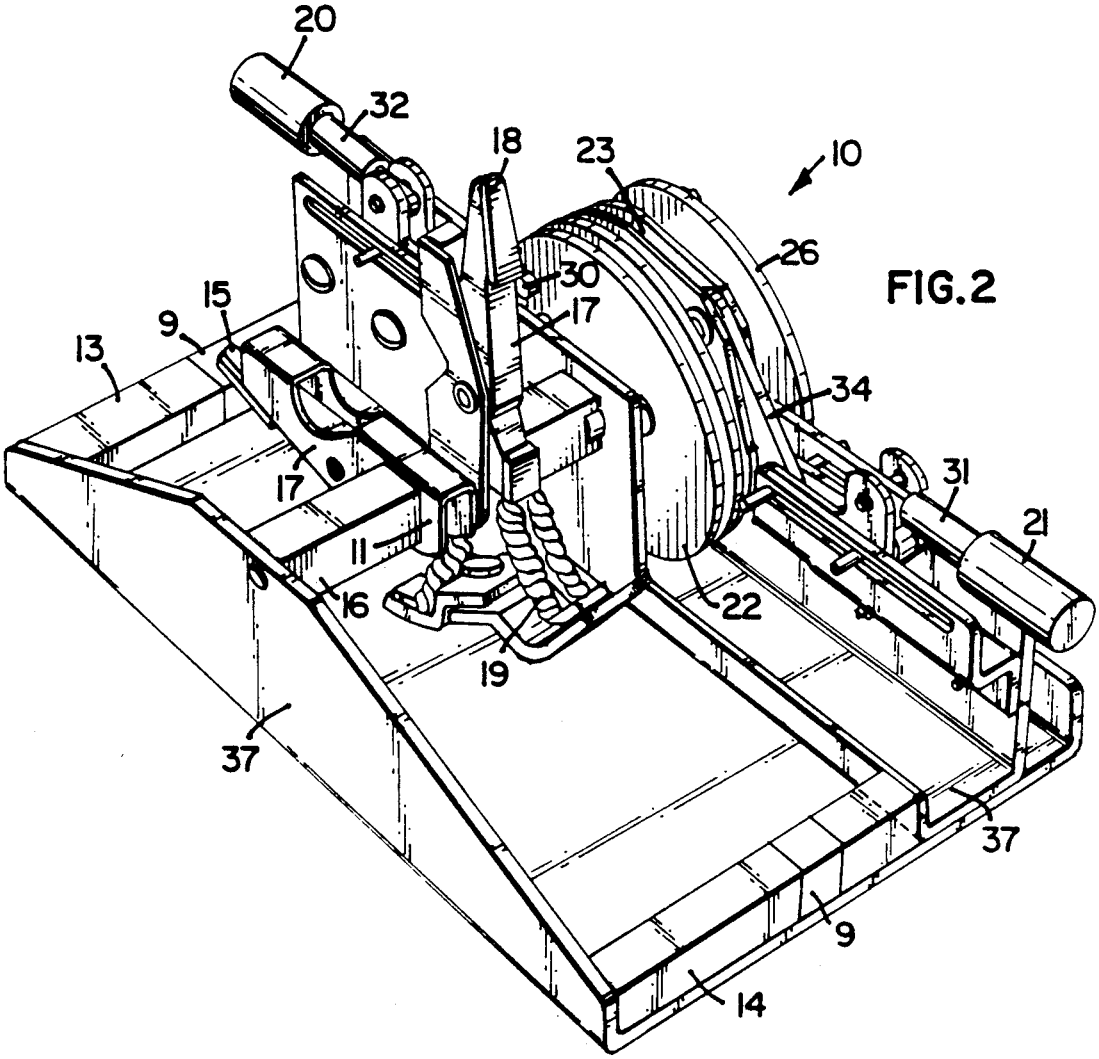
FIG. 2 is a perspective view of the actuating mechanism and transfer switch, as viewed from the opposite side as FIG. 1.

Referring to FIGS. 1–2, the actuating mechanism of the present invention is illustrated generally at 10, in conjunction with a transfer switch 11. The transfer switch 11 moves between a pair of stationary contact blocks 13, 14 which correspond to the normal power source and standby or emergency power source respectively. There are one or more stationary contacts 9 within each of the contact blocks 13, 14. Although there is only one set of contacts 9 illustrated in FIG. 1, it is to be understood that the number of contacts would depend upon the number of phases. Thus, if the particular application required a transfer switch which could accommodate multiple phases, then multiple sets of main contacts 15, 18 would be positioned along the contact crossbar 16, and multiple corresponding stationary contacts would be positioned along the contact blocks 13, 14.

The transfer switch 11 transfers the electrical load from one power source to the other and prevents the two power sources from being interconnected to the load at the same time. The actuating mechanism 10 transfers the power automatically by activating and moving suitable main contacts 15, 18 to perform transfers of power from either source. The contacts 15, 18 are arranged such that they cannot both be in contact with a power source at the same time.

In the preferred embodiment, the transfer switch 11 has a contact crossbar 16 upon which are mounted the contacts 15, 18. The contacts 15, 18 are positioned on the distal end of extension fingers 17 which extend outwardly in a perpendicular relationship from the crossbar 16. The first contact 15 corresponds to the normal or primary power source, whereas the second contact 18 corresponds to the standby or emergency power source. Electrical wires 19 extend from the contact arms 17 and are interconnected to the load terminals (not shown). The actuating mechanism 10 serves to rotate the crossbar or shaft 16 in order to accomplish the transfer procedure, as will be more fully described below.

Figure 5A:
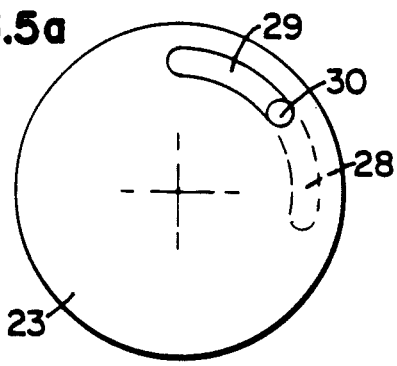
FIGS. 5a–5c are schematic views of three positions of the disks of the actuating mechanism, as viewed from the side of the transfer switch.

The actuating mechanism 10 is a three-position mechanism operated by two solenoids 20, 21. The disk assembly or actuator 10 is mounted upon a suitable support or bracket assembly 37. Energization of suitable linear actuating means causes rotation of the disk assembly 10 and causes the transfer of power between the two sources. The actuator 10 has three positions: 1. a first position, as illustrated in FIG. 5c, in which the contact 15 is electrically connected to the primary or normal power source; 2. a central, neutral position in which neither contact 15, 18 is connected to a power source; and 3. a third position, as illustrated in FIG. 5a, in which the contact 18 is connected to the standby or emergency power source.

The actuator 10 has two disk drives 22, 23. The first disk drive 22 is proximate the crossbar 16, whereas the second disk drive 23 is in a parallel relationship to the first disk drive 22. In the preferred embodiment, the disk drives 22, 23 are approximately $2\frac{1}{2}$ inches in diameter. Each disk drive 22, 23 is identical in construction, and a shaft 25 extends through central apertures in each disk drive, the shaft 25 (see FIG. 3) being in alignment with the crossbar 16. The shaft 25 is interconnected to the crossbar by suitable means. For example, the shaft 25 may be a screw with one end extending into a central aperture in the cross bar 16, with suitable tightening means (not shown) interconnecting the shaft end within the cross bar 16. One end of the shaft 25 terminates in a screw head 27. Thus, rotation of the shaft 25 causes rotation of the crossbar 16 and contacts 15, 18.

The actuator 10 also includes an end disk or driven disk 26 (shown in FIGS. 1 and 3) which is preferably of the same size as the disk drives 22, 23 and in parallel relationship thereto. The shaft 25 is interconnected to the end disk 26, so that rotation of the end disk 26 causes rotation of the shaft 25.

Each of the disk drives 22, 23 has a cut out slot 28, 29 respectively. As illustrated, the slots 28, 29 are configured so as to be circumferential and proximate the outside edge of the disk drives 22, 23. Preferably, the slots 28, 29 are of the same size and extend the length of approximately a 45 degree arc. Extending through the slots 28, 29 is a pin 30. The pin 30 is sized and configured so as to have a diameter which is slightly less than the width of the slots 28, 29 so as to be slideably movable within the slots 28, 29. The pin 30 is interconnected to the end disk 26 by welding or other suitable means.

In the preferred embodiment, there is a spring 38, one end of which is interconnected to the pin 30, and the opposite, lower end being interconnected to the stationary bracket 37. The spring 38 serves to accelerate movement of the disk drives 22, 23 during the transfer process and also maintains the contacts 15, 18 against the appropriate stationary contact 9.

Figure 3:
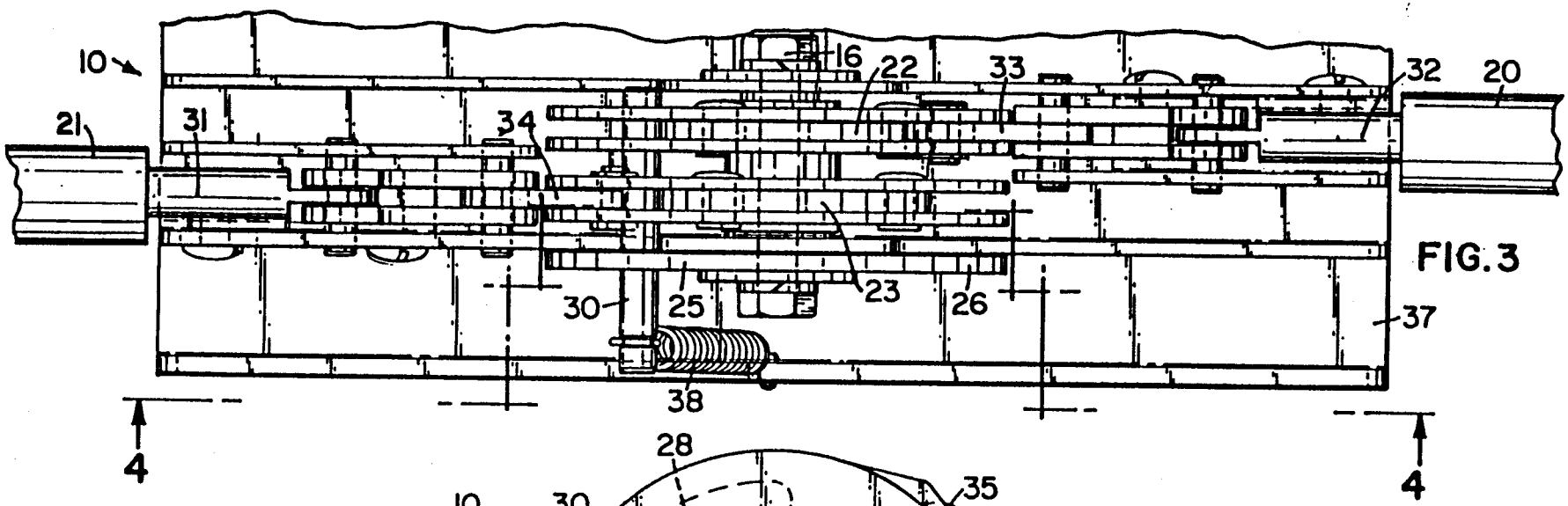
FIG. 3 is a plan view of the actuating mechanism.

Each disk drive 22, 23 is operatively linked to linear actuating means, which preferably consists of electromagnetic means and an energizing circuit therefor. In the preferred embodiment, the electromagnetic means comprises two solenoids 20, 21. As illustrated in FIGS. 1, 2 and 3, the first solenoid 20 is interconnected to the first disk drive 22, whereas the second solenoid 21 is interconnected to the second disk drive 23. In the preferred embodiment, the solenoids 20, 21 are of the type sold by Trombetta Corporation of Milwaukee, Wis., Part No. P-514 or Q-514. It is also within the scope of the present invention to construct the actuator 10 with a single solenoid.

Each solenoid 20, 21 has a plunger 31, 32 respectively. The disk drives 22, 23 and solenoid plungers 31, 32 are interconnected by suitable linkage means, there being a pair of linkages 33, 34 respectively in the preferred embodiment. Preferably, each disk drive 22, 23 consists of two circular plates 40 in parallel relationship, each plate having a central aperture. The disks or plates 40 for the disk drives 22, 23 are spaced a relatively small distance from each other and are interconnected proximate their central portion. In the preferred embodiment, the linkages 33, 34 are elongated, relatively flat members, with the inner end of each linkage 33, 34 fitting within the space between the two disks 40 which comprise each of the disk drives 22, 23. The linkages 33 and 34 each carry a coupling pin at their connection to the drive disk. Each linkage 33, 34 has a connector on both ends thereof: an inner connector 35 which is attached to the disk drives 22, 23, and an outer connector 36 which is attached to guide members or levers 40, 41, which are in turn interconnected to the inner ends of the solenoid plungers 31, 32. In the preferred embodiment, the outer connectors 36 are roll pins, whereas the inner connectors 35 are clevis pins. It is also within the scope of the present invention for the linkages 35, 36 to be directly interconnected to the pin 30. Each guide member 40, 41 is held slidably in corresponding guide slots 42, 43 in the framework 37. The ends of the slots 42, 43 serve to limit movement of the members 40, 41.

When one of the solenoids 20 or 21 is energized, its plunger 31 or 32 becomes magnetized and causes the plunger 31 or 32 to move within the solenoid body 20 or 21. Upon deenergization, a plunger spring or other biasing means within the solenoid (not shown) biases the plunger 30 or 31 to push it outside of the solenoid 20 or 21. Thus, deenergization of the solenoid causes the plunger 30 or 31 to move into a position outside the solenoid housing, as illustrated in FIGS. 1-4. This deenergization position is referred to as the solenoid plunger's inward position with respect to the disk assembly 10 or unretracted position. FIGS. 1-4 illustrate a situation in which neither of the solenoids 20 nor 21 is actuated.

In the preferred embodiment, energization of the solenoid 20 or 21 exerts approximately a 70-80 pound force on the corresponding solenoid plunger 31 or 32. When the plunger 31 or 32 is in the energized position, the spring within the solenoid exerts approximately a 20 pound force in the opposite direction. The solenoid 20 or 21 is engaged momentarily and operates rapidly, on the order of two to three seconds. The solenoids 20, 21 are activated by suitable control means (not shown).

During the transfer operation from one of the power sources to the neutral position, one solenoid is energized and activates the linkage connected to it. If it is then desired to transfer from the neutral position to the opposite power source, the other solenoid is subsequently energized to activate its corresponding linkage. If, on the other hand, it is desired to return to the original power source from the neutral position, the first solenoid is energized for a second time. When activated, the linkages 33, 34 apply inertial torque to the drive disk and generate rotational speed. Activation of the solenoid(s) causes rotation of the drive disk's axis 25 and the contact cross bar 16, thereby allowing appropriate electrical contact to be made.

Figure 4:
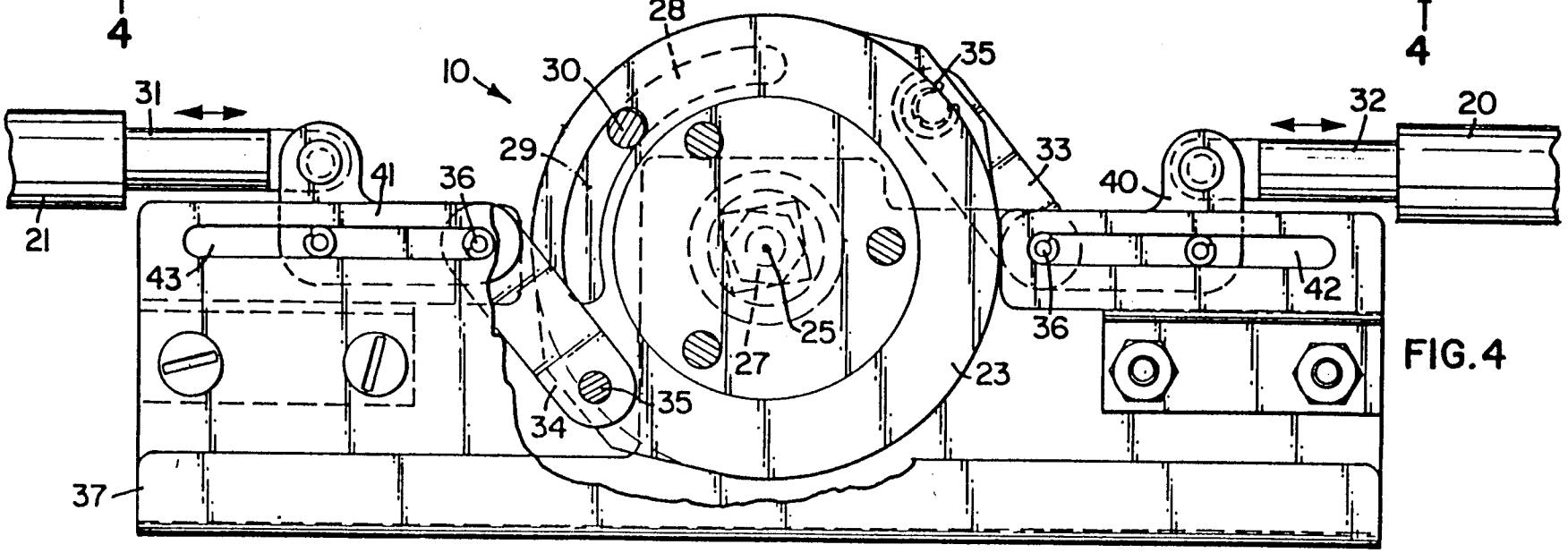
FIG. 4 is a side elevational view, partially cutaway, of the actuating mechanism taken along line 4—4 of FIG. 3.

More specifically, the transfer operation from the normal power source to the emergency power source will now be described. One of the two solenoids is actuated (in this case, the second solenoid 21), as by passing a current therethrough. The second solenoid plunger 31 moves to its outer or retracted position within the solenoid body, thereby causing the second disk drive 23 to move in a clockwise direction, as viewed in FIGS. 2-5 or in a counterclockwise direction, as viewed in FIG. 1. Before activation of the second solenoid 21, the pin 30 is at the right end of the slot 29 in the second disk 23, and the pin 30 is at the left end of the slot 28 in the first disk, as illustrated in FIGS. 4, 5*c* and 6*a*. Referring to FIG. 4, movement to the left of solenoid plunger 31 causes the linkage 34 to be pulled into a substantially horizontal position, and causes the second disk drive 23 to move in a clockwise direction. After the plunger 31 has reached the outermost point and begins to return toward the right, the linkage 34 does not return to its original position but instead rotates so that the right end (as viewed in FIG. 4) of the linkage 34 is above its left end. Consequently, inward movement of the plunger 31 causes clockwise movement of the disk 23, which in turn causes clockwise movement of the drive disk 22, the end disk 26, the central shaft 25, and the crossbar 16. When the solenoid plunger 31 comes to a rest in its retracted position, the assembly 10 is in the neutral position illustrated in FIG. 6*b*, in which neither contact is in electrical connection with either power source. That is, the contacts 15 and 18 are not in contact with either contact block 13 and 14. The neutral position can be maintained for a predetermined amount of time by means of a suitable timer mechanism.

Figure 6A:
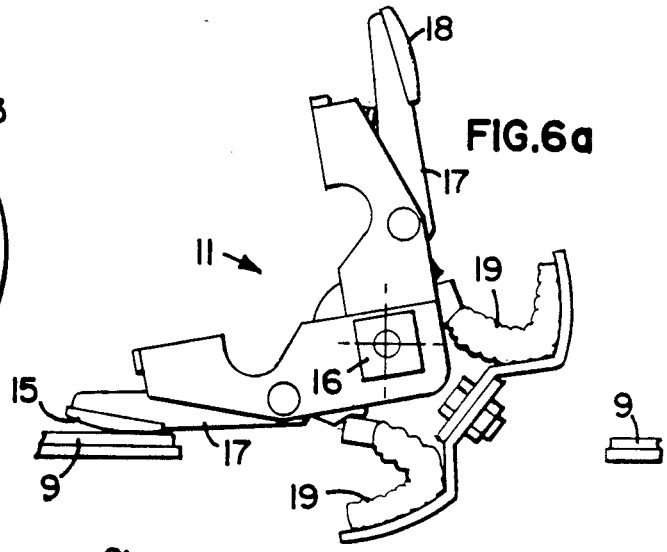
FIGS. 6a–6c side views of the contact arms in the three positions corresponding to the positions shown in FIG. 5.

In order to then complete the transfer procedure by moving from the neutral position to the emergency power source, the first solenoid 20 is then actuated. As viewed in FIG. 4, the solenoid plunger 32 moves in the right direction, thereby causing the linkage 33 to assume a horizontal position, and causing the disk 22 to rotate in the clockwise direction. When the plunger 32 moves to the left to its unretracted position, the left end of the linkage 33 moves below the right end of the linkage 33. As a result, inward movement of the plunger 32 causes rotation of the drive disk 22, the driven disk 23, the end disk 26, and the crossbar 16. After this transfer operation, the pin 30 is at the left end of the slot 28 in the first disk 22 and at the right end of the slot 29 in the second disk 23, as viewed from the side opposite the contacts and as illustrated in FIG. 5*a*. The end result is that electrical contact is made with the emergency power source, and the position of FIG. 6*c* is achieved.

The linkages 33 or 34, during the energization process, apply inertial torque to the disk drives 22 or 23 to generate rotational speed which causes movement of the crossbar 16 and causes transfer to the other contact block 14. The rotational inertia overcomes the force of the spring 38. When the contact 15 or 18 comes to rest on the appropriate power source contact block 13 or 14, the transfer operation is complete.

Transfer of the contacts from the emergency source to the normal source proceeds along the same basis outlined above, except that the first solenoid 20 is initially activated to begin the transfer process, and the corresponding first disk 22 acts as the drive disk. The disk 23 acts as the drive disk during transfer from normal mode to emergency mode, whereas the disk 22 acts as the drive disk during transfer from emergency mode to normal mode.

Figure 5B:
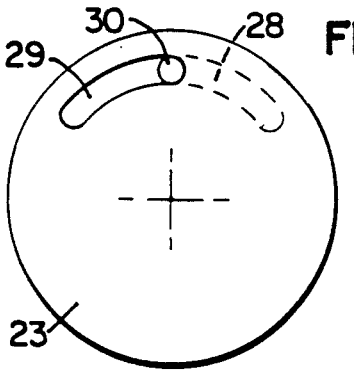
Figure 5C:
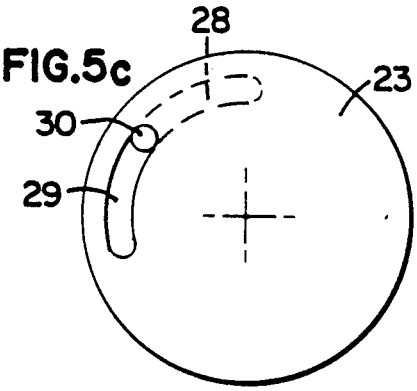

FIGS. 5*a*-5*c* illustrate the three positions of the disk drives 22, 23 with respect to the pin 30. FIGS. 5*a*, 5*b* and 5*c* correspond to the emerging power source mode, the neutral mode, and the normal power source mode respectively. The slot 29 on the second disk drive 22 is illustrated with a solid line, whereas the slot 28 on the first disk drive 22 is illustrated with the dashed, hidden lines. FIG. 5*c* illustrates the same configuration as is shown in FIG. 3.

Figure 6B:
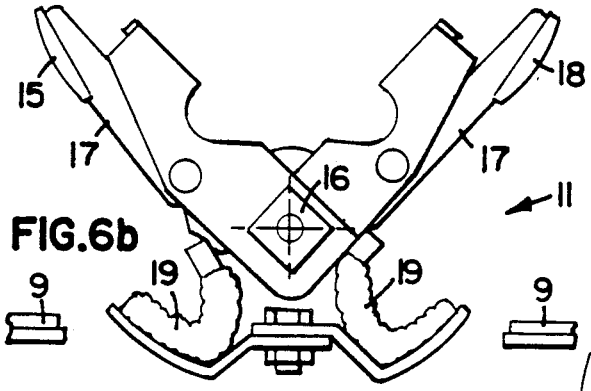
Figure 6C:
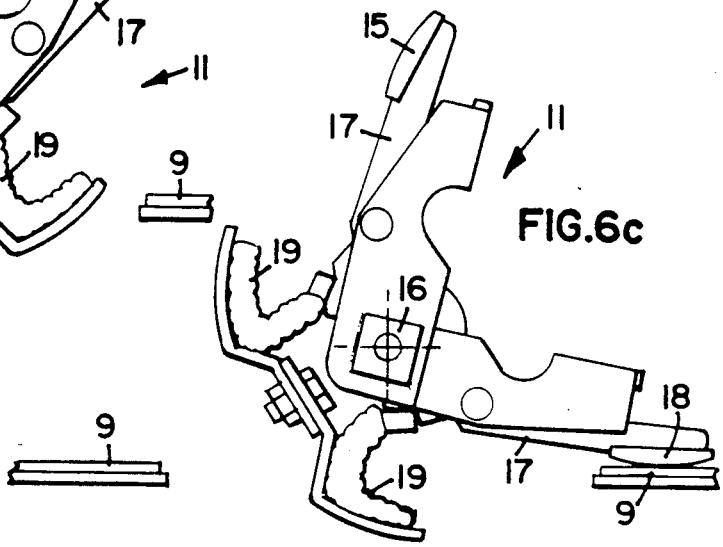

FIG. 6 illustrates the three positions corresponding to the three modes illustrated in FIG. 5. That is, FIGS. 5*a*, 5*b*, and 5*a* correspond to FIGS. 6*a*, 6*b*, and 6*c*, and correspond to the normal power source mode, the neutral mode, and the emergency power source mode respectively.

Even though numerous characteristics and advantages of the invention have been set forth in the foregoing description, together with details of the structure and function of the invention, the disclosure is illustrative only, and changes can be made in detail, especially in matters of shape, size and arrangement of parts, within the principles of the invention, to the full extent indicated by the broad general meaning of the appended claims.

What is claimed is:

1. A transfer switch for transferring an electrical load from a normal power source to an emergency power source, and vice versa, comprising:

(a) a rotatable cross bar which rigidly supports a plurality of movable contacts, said movable contacts being rotatable between a position contacting a normal power source stationary contact, a position contacting an emergency power source stationary contact, and an intermediate neutral position therebetween;

(b) a driven disk having a shaft which is interconnected to said rotatable cross bar, said driven disk having an eccentric pin, wherein rotation of said driven disk causes rotation of said cross bar;

(c) first and second rotatable drive disks in parallel relationship to each other and to said driven disk, each of said drive disks having an arcuate slot which slidably accommodates said pin; and (d) linear actuating means operably interconnected to said pin so as to cause arcuate movement thereof, wherein a transfer from one of said power source positions to a neutral position results in free movement of said pin in said slot of one of said drive disks, said other drive disk's rotation causing rotation of said driven disk and rotation of said cross bar.

2. The apparatus of claim 1, wherein said actuating means comprises electromagnetic means and an energizing circuit therefor.

3. The apparatus of claim 2, further comprising a first and second linkage means disposed between and interconnecting said first and second drive disks and said linear actuating means.

4. The apparatus of claim 3, wherein said electromagnetic means comprises a pair of solenoids, each solenoid having biasing means which force said linkage means in an inward direction relative to said drive disks.

5. The apparatus of claim 4, wherein said linear actuating means comprises a pair of solenoids having plungers which are pivotally interconnected to an eccentric point on each of said drive disks respectively.

6. The apparatus of claim 5, wherein each of said drive disks comprises a pair of circular plates in parallel relationship, each of said plates having an arcuate slot in parallel relationship.

7. The apparatus of claim 6, further comprising a pair of linkages which have pivotal connection means on each end to as to pivotally interconnect said solenoid plungers and drive disks respectively, an inner end of said linkages being positioned between said circular plates.

8. A transfer switch for transferring an electrical load from a normal power source to an emergency power source, and vice versa, comprising:

(a) a rotatable cross bar which rigidly supports a plurality of movable contacts, said movable contacts being rotatable between a position contacting a normal power source stationary contact, a position contacting an emergency power source stationary contact, and an intermediate neutral position therebetween;

(b) a driven disk having a shaft which is interconnected to said rotatable cross bar, said driven disk having an eccentric pin, wherein rotation of said driven disk causes rotation of said cross bar;

(c) first and second rotatable drive disks in parallel relationship to each other and to said driven disk, each of said drive disks having an arcuate slot which slidably accommodates said pin; and (d) a pair of solenoids having plungers which are pivotally interconnected by linkages to an eccentric point on each of said drive disks respectively, wherein actuation of a solenoid causes rotation of said drive disk interconnected thereto.

9. The apparatus of claim 8, wherein each solenoid includes biasing means which force said linkages in an inward direction relative to said drive disks.

10. The apparatus of claim 9, wherein each of said drive disks comprises a pair of circular plates in parallel relationship, each of said plates having an arcuate slot in parallel relationship.

* * * * *

UNITED STATES PATENT AND TRADEMARK OFFICE

CERTIFICATE OF CORRECTION

PATENT NO. : 4,999,598

DATED : March 12, 1991

INVENTOR(S) : Michael J. Jannesari
Alan N. Fabian

It is certified that error appears in the above-identified patent and that said Letters Patent is hereby corrected as shown below:

Column 3, line 10, after the word "the" and before the word "transfer", please insert --actuator opposite the--.

Column 5, line 59, after "2-5", please insert --,--.

Column 6, line 54, please delete "emerging" and insert --emergency--.

Column 6, line 62, please delete "5a" and insert --5c--.

Column 7, line 31, please delete "disks," and insert -- disks and causes rotation of the other of said two drive disks,".

Column 8, line 11, please delete "to as" and insert --so as--.

Signed and Sealed this

Fifteenth Day of September, 1992

*Attest:*

DOUGLAS B. COMER

*Attesting Officer*

*Acting Commissioner of Patents and Trademarks*